US006234058B1

(12) United States Patent
Morgado

(10) Patent No.: US 6,234,058 B1
(45) Date of Patent: May 22, 2001

(54) SEMIAUTOMATIC POCKET GUN AND AMMUNITION

(76) Inventor: Ralph Gordon Morgado, 1825-A Addison Way, Hayward, CA (US) 94545

( * ) Notice: Subject to any disclaimer, the term of this patent is extended or adjusted under 35 U.S.C. 154(b) by 0 days.

(21) Appl. No.: 08/938,088

(22) Filed: Sep. 26, 1997

(51) Int. Cl.[7] ..... F41A 9/17

(52) U.S. Cl. ..... 89/33.03; 89/155; 42/9; 42/27; 42/39.5; 102/376

(58) Field of Search ..... 89/33.03, 155, 89/156; 42/9, 27, 39.5; 102/376, 432

(56) References Cited

U.S. PATENT DOCUMENTS 1,191,357 7/1916 Snyder .
2,307,369 1/1943 Ferrel .
3,952,657 4/1976 Kaltmann .
3,997,994 12/1976 Kastner et al. .
4,152,857 5/1979 Ketterer .

*Primary Examiner*—Stephen M. Johnson
(74) *Attorney, Agent, or Firm*—Flehr Hohbach Test Albritton & Herbert LLP

(57) ABSTRACT

Semiautomatic pistol which is small enough to be carried in a pocket or otherwise concealed on the body of a person, and caseless ammunition for use in the pistol. The pistol has a grip adapted to be held in the hand of a shooter, a barrel extending in a forward direction from the grip, a closed chamber at the rear of the barrel, means for firing a caseless cartridge in the chamber with the entire cartridge being discharged through the barrel, and means responsive to the firing of the cartridge for opening the chamber and loading another cartridge into the chamber. The caseless cartridge consists of a hollow projectile filled with gunpowder, and a primer for igniting the powder. The primer is mounted directly to the projectile, and there is no casing or other material to ejected from the chamber before another round is loaded.

24 Claims, 10 Drawing Sheets

SEMIAUTOMATIC POCKET GUN AND AMMUNITION

This invention pertains generally to firearms and cartridges and, more particularly, to a semiautomatic pistol of a size small enough to be carried in a pocket or other concealed location, and to ammunition for use therein.

Because of inherent size limitations, pocket guns heretofore provided have had very limited fire power and very poor accuracy. Such guns are typically .22 or .32 caliber and have barrels which are no more than about two inches long. They tend to be relatively heavy and difficult to hold, with room for only two fingers on the grip below the trigger. Accuracy is limited not only by the shortness of the barrel, but also by a tendency of the barrel to rise when the gun is fired.

Because of the complexity of the action and the need to expel the casings of spent cartridges, it is very difficult to design a pocket gun which can be fired semiautomatically.

It is in general an object of the invention to provide a new and improved firearm and ammunition.

Another object of the invention is to provide a firearm and ammunition of the above character which overcome the limitations and disadvantages of pocket guns and ammunition of the prior art.

These and other objects are achieved in accordance with the invention by providing a semiautomatic pistol which is small enough to be carried in a pocket or otherwise concealed on the body of a person, and caseless ammunition for use in the pistol. The pistol has a grip adapted to be held in the hand of a shooter, a barrel extending in a forward direction from the grip, a closed chamber at the rear of the barrel, means for firing a caseless cartridge in the chamber with the entire cartridge being discharged through the barrel, and means responsive to the firing of the cartridge for opening the chamber and loading another cartridge into the chamber.

The caseless cartridge consists of a hollow projectile filled with gunpowder, and a primer for igniting the powder. The primer is mounted directly to the projectile, and there is no casing or other material to ejected before another round is loaded.

Figure 1:
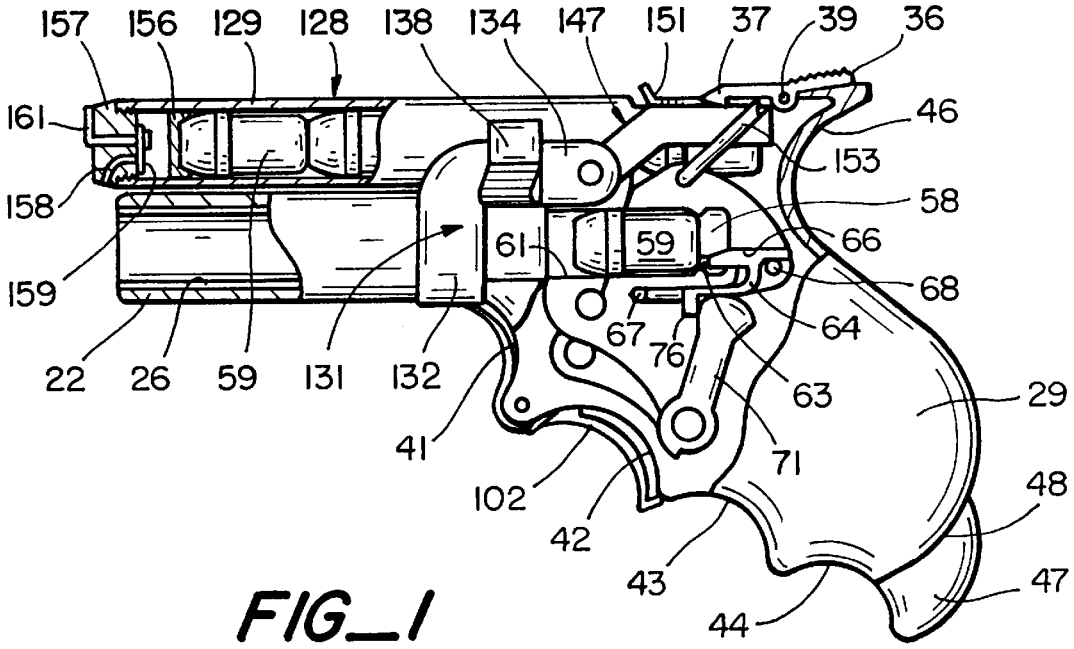
FIG. 1 is a side elevational view, partly broken away, of one embodiment of a semiautomatic pistol according to the invention.
Figure 2:
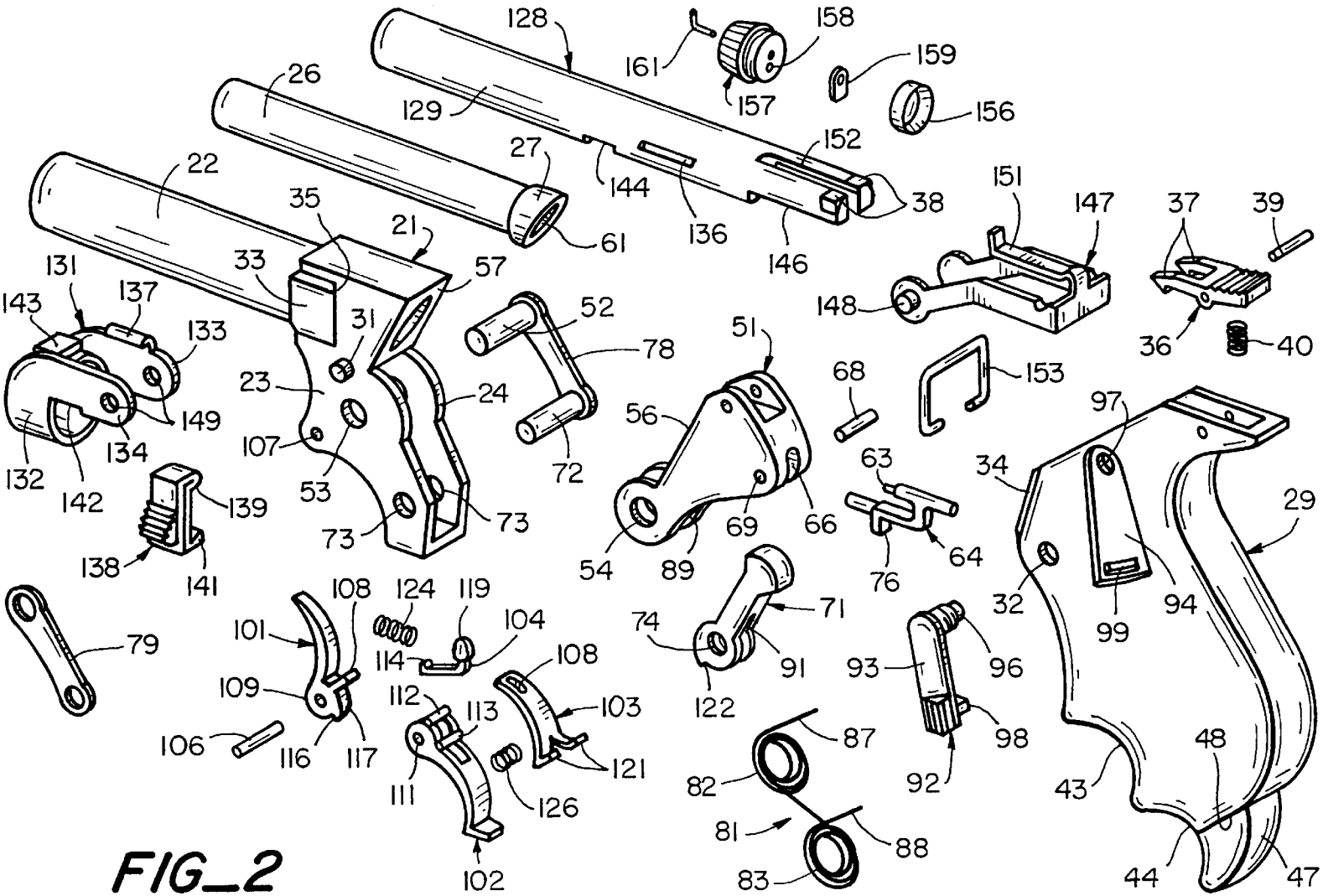
FIG. 2 is a an exploded isometric view of the embodiment of FIG. 1.
Figure 4:
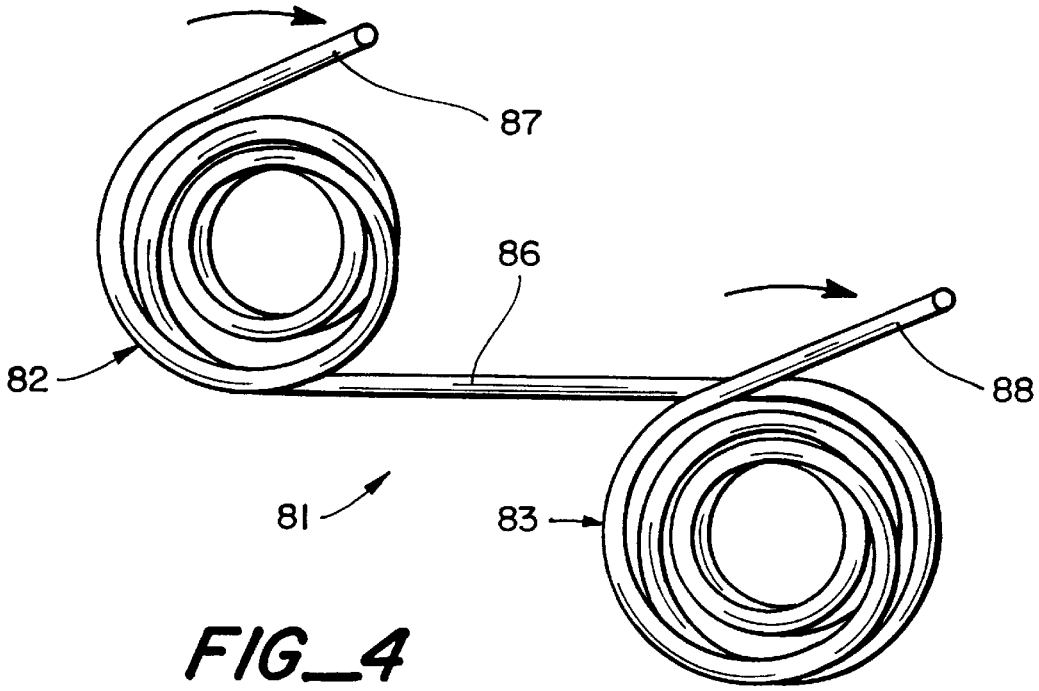
FIG. 4 is an enlarged side elevational view of the hammer and breech spring in the embodiment of FIG. 1.
Figure 5:
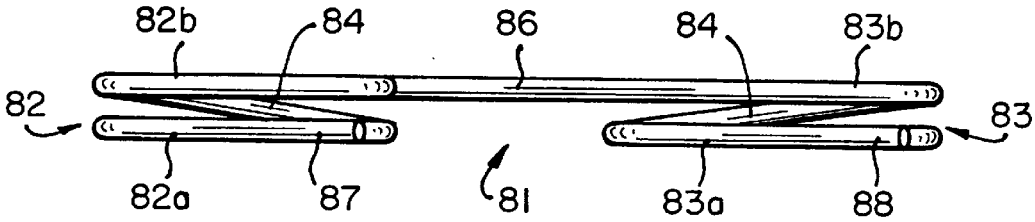
FIG. 5 is an enlarged top plan view of the hammer and breech spring shown in FIG. 4.

As illustrated in FIGS. 1–2, the pistol has a frame or receiver 21 which includes a barrel 22 and a handle portion comprising a pair of side plates 23, 24 that extend downwardly and somewhat to the rear of the barrel. The frame is fabricated as a one-piece structure of a lightweight material such as aluminum which is also a good conductor of heat. A liner 26 of a stronger material such as stainless steel is press-fit into the barrel, with an enlarged end portion 27 at the rear of the liner preventing the liner from being driven forward by bullets fired through the gun.

Figure 3:
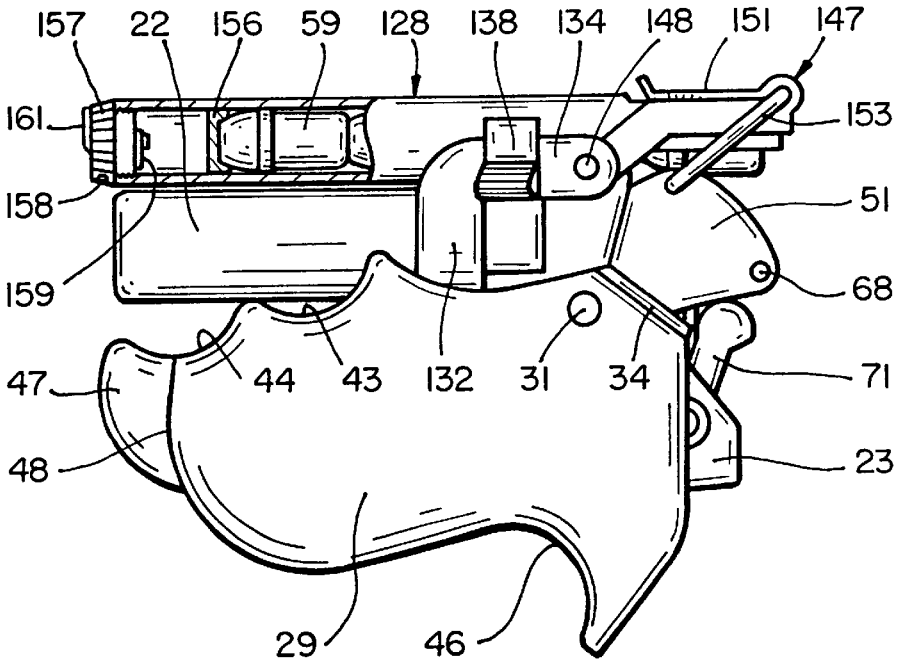
FIG. 3 is a side elevational view of the embodiment of FIG. 1, with the grip in a folded position.

A folding grip 29 is mounted on the handle portion of the frame. The grip has a hollow body which is open in front and is pivotally mounted on the frame by trunions or pins 31 which project laterally from the frame and are received in openings 32 in the sides of the grip. The grip can be moved between a normal position shown in FIG. 1 and the folded position shown in FIG. 3. In the normal position, the grip extends downwardly and to the rear of the barrel, and in the folded position, it swings up generally parallel to barrel. In the normal position, the front sides of the grip abut against blocks 33 which project laterally from the frame, with tabs 34 on the grip being received in tapered notches 35 at the rear of the blocks. A latch 36 at the top of the grip has a pair of hooks 37 which engage lugs 38 on the magazine housing to lock the grip in that position. The latch is pivotally mounted on a pin 39, with a spring 40 beneath the rear portion of the latch urging the hooks down into engagement with the lugs.

The grip is fabricated of a material such as wood, plastic, with one presently preferred material being a plasticized wood, i.e. wood which as been impregnated with a plastic resin. However, it can be made of any other suitable, if desired.

The grip and the handle of the receiver are contoured to fit the hand of a shooter, and for this purpose they have recessed areas 41–44 along their front edges for receiving the four fingers of the shooter's hand. The grip also has a recessed area or backrest 46 on its rear side for receiving the web between the thumb and forefinger of the hand. The lower portion 47 of the grip is narrower than the rest of the grip, with a rounded shoulder 48 above it which rests on the curved part of the heel of the hand near the pinky. With this contour, the middle finger, ring finger, pinky and thumb can all wrap securely about the grip, with forefinger on the trigger and the barrel in close alignment with the axis of the shooter's arm.

In this regard, the axis of the barrel intersects the grip somewhat below the recessed area at the back of the grip, and at an angle such that the barrel will be aligned only slightly above the axis of the forearm of the shooter when the grip is held in the hand with the top of the shooter's wrist level with the top of the forearm. This alignment substantially eliminates muzzle rise when the gun is fired.

A breech block 51 is rotatively mounted between the side plates of the frame for movement between loading and firing positions. This block is mounted on a pin 52 which extends between aligned openings 53 in the side plates and passes through a bore 54 in the block. The block has an inclined front face 56 which seats against a corresponding surface 57 at the rear of the barrel when the block is in the firing position.

A chamber 58 for holding a cartridge 59 to be fired is formed in the breech block. This chamber is in the nature of a blind bore which opens through the inclined face and aligns with the bore 61 of the barrel when the block is in the firing position, with the nose of the bullet extending into the rear portion of bore 61. In the loading position, the breech block is rotated back away from the barrel, with the chamber bore inclined at an angle on the order of 45° for receiving the next round from the magazine.

The breech block is fabricated of a material such as titanium which is relatively strong, light in weight, and has a low coefficient thermal expansion.

A firing pin 63 is mounted on a carrier 64 at the rear of the chamber. The pin extends into the chamber through a bore 66 in the block, and the carrier is slidably mounted in a slot 67 which opens toward the bottom and the rear of the block. The carrier is retained in the slot by a pin 68 which extends between cross-bores 69 in the block and limits rearward travel of the firing pin.

A hammer 71 is rotatively mounted between the side plates of the frame below the breech block for movement between rest and cocked positions. The hammer is mounted on a pin 72 which extends between aligned openings 73 in the side plates and passes through a bore 74 toward one end of the hammer. The head of the hammer engages a flange 76 on the firing pin carrier to drive the firing pin in a forward direction when the hammer is released from its cocked position. Pins 52 and 72 are affixed to a base plate 78 on the outer side of side plate 24 and held in position by a retaining plate 79 on the outer side of side plate 23.

When the hammer is in its rest position, it serves as a lock for the breech block, holding the block in its firing position. This prevents rearward movement of the breech block when the gun is fired and helps to maintain a tight seal between the front face of the breech block and the rear face of the barrel. Before the breech block can be moved from that position, the hammer must be rotated slightly toward its cocked position to unlock the breech.

The breech block and hammer are urged toward their firing and rest positions by a double coil spring 81. This spring has two sections 82, 83, each of which has two spiral windings 82*a*, 82*b* and 83*a*, 83*b* positioned side-by-side, with a cross-over 84 between the inner convolutions of the two windings in each section. The two sections are wound from a single length of spring wire, with a link 86 between the two sections and the two ends of the wire extending in a tangential direction from the coils to form arms 87, 88. The coils are disposed coaxially about pins 52, 72, with arms 87, 88 being received in slots 89, 91 on the under or rear sides of the breech block and hammer.

Having the two windings side-by-side in each section provides a spring action comparable to that of a single spring having as many turns as the two windings combined, but in a smaller space than the single spring would occupy. The extended action is important in this particular gun since the hammer rotates through an angle on the order of 90° between its rest and cocked positions, and the compact size of the spring is important since space is limited in a gun of this nature.

With the two sections of the spring connected together, the tightening of windings 83*a*, 83*b* which occurs when the hammer is cocked exerts a pull on the link between the two sections. That pull tightens windings 82*a*, 82*b*, thereby increasing the force exerted against the breech block by arm 87 and tightening the seal between the breech block and the barrel.

Grip 29 also serves as a cocking lever, and for this purpose, it has a catch 92 for engaging the breech block and the hammer to move them to their loading and cocked positions as the grip is rotated toward its folded position. The catch comprises a lever arm 93 which is pivotally mounted in a recessed area 94 on one side of the grip, with a pin 96 toward the top of the arm extending through an opening 97 in the grip and a lug 98 toward the bottom of the arm extending through an arcuate slot 99. The pin is positioned for engagement with the front of the breech block above the barrel, and the lug is positioned for engagement with the front of the hammer just below the head.

The arm is laterally flexible so that lug 98 can be extended by depressing the lower portion of the arm, and pin 96 is threadedly mounted in opening 97 so that the pin advances in an inward direction as the lever arm is rotated from the front toward the back of the recessed area. When the arm is depressed and rotated, lug 98 engages the hammer and moves it away from its rest position to unlock the breech block. At the same time, pin 96 advances into position for engaging the breach block. Thereafter, when the grip is rotated, pin 96 engages the breech block and moves it to its loading position, with the breech block engaging the hammer and rotating it to its cocked position.

If a cartridge is already in the chamber, the hammer can be cocked by depressing lever arm 93 to extend lug 98, without rotating the arm to extend pin 96, then rotating the grip halfway toward its folded position, with the lug engaging the hammer and moving it to its cocked position. Since pin 96 is not extended, the breech block remains in the firing position with the chamber closed.

Pin 96 and lug 98 will only engage the breech block and hammer when the lever arm is depressed and rotated to the back of the recessed area. With the lever arm in its rest position, the pin and the lug clear the breech block and hammer, and the grip can be moved to its folded position without disturbing them.

When the gun is fired, blowback from the cartridge in the chamber drives the firing pin back, with flange 76 engaging the hammer to move it back far enough to unlock the breech block. With the breech block thus unlocked, the blowback then drives the breech block back to its loading position, and the hammer is rotated to its cocked position by the breech block.

A trigger assembly is mounted between the side plates in front of the breech block and hammer. This assembly includes a primary trigger 101, a safety trigger 102, a hammer sear 103 and a sear hook 104. The primary trigger and the safety trigger are rotatively mounted on a pin 106 which extends between aligned openings 107 in the side plates, with the primary trigger in an inverted position and the safety trigger in an upright position. This pin is located between recessed areas 41, 42 at the front of the grip, and the two triggers have curvatures corresponding to the contours of those recesses.

The primary trigger has a tang 108 which extends in an upward direction from the base portion 109 of the trigger. The upper portion of the safety trigger is bifurcated and has a pair of flanges 111 which embrace the base portion 109 of the primary trigger, with a crossarm 112 extending between the flanges in front of tang 108.

Hook 104 extends between flanges 111 and beneath a second crossarm 113 on safety trigger 102. Toward its front end, the hook has a rearwardly facing shoulder 114 which engages a forwardly facing shoulder 116 on the under side of primary trigger 101. The trigger has a cam surface 117 to the rear of shoulder 116 for depressing the front portion of the hook to disengage the hook from the trigger when the trigger is pulled. The rear portion of the hook passes through an opening 118 in the sear, with an enlarged head 119 preventing the hook from dropping out of the sear. The lower surface of the head is rounded for engagement with the sear.

The rear portion of the sear is bifurcated and has a pair of upwardly extending teeth 121 which engage radial shoulders 122 on the under side of hammer 71 to hold the hammer in its cocked position.

Trigger 101 is biased in a forward direction and the front portion of hook 104 is biased in an upward direction toward the lower surface of the trigger by a compression spring 124 which is disposed between the rear side of tang 108 and the enlarged head 119 at the rear of the hook. Safety trigger 102 is biased in a forward direction and the teeth on the sear are biased in an upward direction against the lower surface of the hammer by a compression spring 126 which is disposed between the safety trigger and the sear.

When the hammer is in its cocked position, the teeth on the sear engage the shoulder on the hammer, and the safety trigger is held in its forward or extended position by spring 126. With the safety trigger in this position, crossarm 112 pulls back on tang 108, holding trigger 101 in a retracted position inside the front portion of the grip where it cannot be pulled. When the trigger is in this position, cam surface 117 depresses sear hook 104 and holds it out of engagement with the shoulder 116 on the trigger so that the trigger cannot release the sear from the hammer.

The safety is released by pulling back on the safety trigger, which rotates crossarm 112 in the forward direction away from tang 108 and allows trigger 101 to swing out of the grip to its forward or extended position. As the trigger moves in this direction, cam surface 117 allows the sear hook to move in an upward direction, and the shoulder 116 on the trigger engages the shoulder 114 on the hook, placing the gun in its firing position.

When the trigger is pulled, shoulder 116 pulls the sear hook forward, drawing the sear out of engagement with the shoulders on the hammer, thereby releasing the hammer to fire. Continued rotation of the trigger brings cam surface 117 into contact with the hook, releasing the hook from the trigger and allowing the sear to reengage the shoulders on the hammer when the hammer returns to its cocked position.

If the safety trigger is now released, it will return to its forward or extended position, thereby withdrawing the trigger and returning the gun to the safety position. If however, the safety trigger is held back, the primary trigger will return to its extended or forward position, and the gun can be fired repeatedly in a semiautomatic mode by successive pulls of the trigger.

Cartridges 59 are supplied to chamber 58 from a magazine 128 which is positioned above the barrel. In the embodiment of FIG. 1, the magazine has a tubular housing 129 in which the cartridges are stored end-to-end. The magazine is removably mounted on the barrel by a bracket 131 which has a mounting ring 132 that fits around the rear portion of the barrel, with a pair of arms 133, 134 extending from the ring toward the rear of the gun. A pair of longitudinally extending grooves 136 are formed in the sides of the magazine tube, and arm 133 has an inwardly projecting hook 137 which fits into one of these grooves. The other side of the magazine is releasably secured to the bracket by a latch 138 which has hooks 139, 141 that engage the groove in the tube and a notch 142 in the lower edge of arm 134. A square block 143 above the mounting ring engages a socket 144 on the under side of the tube to prevent the magazine from sliding forward or backward in the bracket.

The rear portion of the magazine is positioned above breech block 51, and the tube has an opening 146 on its under side through which the cartridges can pass. A loader 147 is pivotally connected to the arms 133, 134 of the mounting bracket by trunions or pins 148 which pass through aligned openings 149 in the arms. The loader has a longitudinally extending finger 151 which is positioned above the rearmost cartridge in the magazine and passes through a slot 152 in the top wall of the tube for pushing the rearmost cartridge down toward the chamber. That cartridge is visible to the through the slot so that the shooter can tell visually if there are any rounds left in the magazine.

The loader is connected to the breech block by a link 153 for movement with the breech block. Thus, as the breech block swings back and down toward its loading position, the loader also swings down, pushing the rearmost cartridge toward the chamber. With the loader in its rest position, the points at which the link is connected to the breech block are slightly above the centerline between the points where the link is connected to the loader and the pivot axis of the breech block so that movement of the loader is delayed until the breech block has moved back far enough to put the points of connection on the other side of the centerline. This delayed action assures that breech will be fully open before the cartridge is fed to the chamber.

With the breech block in the loading position, the chamber bore is inclined at an angle on the order of 45°, and the cartridge enters the chamber backwards, i.e. primer end first. The inclined faces on the rear of the barrel and the front of the breech block help to guide the cartridge into the chamber, and when the breech snaps closed, the cartridge is chambered.

The cartridges in the magazine are moved toward the rear by a piston 156 which is driven by gas pressure from the muzzle blast when the gun is fired. For this purpose, an end cap 157 at the front of the magazine has a passageway 158 with an inlet opening positioned directly above the front end, or muzzle, of the barrel. Communication through the passageway is controlled by a one-way reed valve 159 on the inside of the cap which allows gas from the muzzle blast to enter the tube and drive the piston. A manually rotatable relief lever 161 is connected to the reed for opening the valve to vent the tube and release the pressure so that the piston can return to its forward position as the cartridges are loaded into the tube from the rear.

Figure 6:
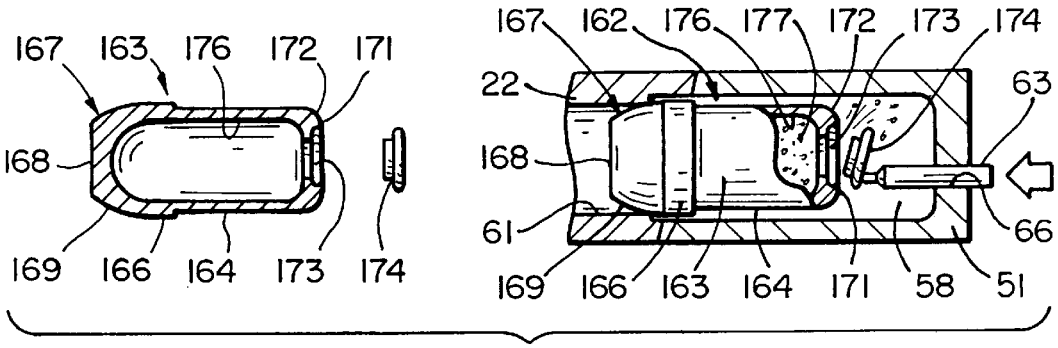
FIG. 6 is a cross-sectional illustrating one embodiment of a caseless cartridge in chamber in the embodiment of FIG. 1 and in flight.

FIG. 6 illustrates a cartridge 162 for use in the embodiment of FIG. 1. This cartridge is a caseless cartridge in which the projectile 163 also serves as a canister for holding the powder charge.

The projectile has a cylindrical side wall 164, with a ring of increased diameter 166 toward the nose of the bullet. The nose 167 has a flat surface 168 at the front and a rounded surface 169 which extends between the flat surface and the ring. At the rear, the side wall terminates in an end wall 171, with a rounded corner 172 between the two. The end wall has a central bore 173 in which a pop-off primer 174 is mounted. The cavity 176 within the projectile is filled with gunpowder 177. Side wall 164 is a few thousands of an inch smaller in diameter than the bore of the barrel, and ring 166 is a few thousandths greater.

The projectile is formed as a unitary structure of brass or other suitable material, and the cartridge can be manufactured by a simple three-step process which consists of forming the projectile, filling it with powder, and installing the primer.

With the cartridge of FIG. 6, the chamber 58 in the breech block is of greater diameter than side wall 164 and ring 166, and the nose of the cartridge extends into the rear portion of the bore 61 in the barrel. The bore is a few thousandths of an inch smaller in diameter than the ring and the rear portion of the nose of the bullet, and it retains the cartridge in the chamber as the firing pin strikes the primer.

When the primer is fired, it ignites the powder in the projectile and separates from the projectile as the powder begins to burn. The gas pressure produced by the burning powder quickly overcomes the holding force of the wall of the bore, and the bullet is propelled out of the chamber and down the barrel. As the bullet travels through the barrel, ring 166 provides a gas-tight seal with the wall of the bore. Separation of the primer is completed while the projectile is travelling down the barrel or shortly thereafter, and the primer continues to travel a few feet beyond the end of the barrel. Even after the bullet has left the gun, some of the powder in the projectile continues to burn and propel the bullet in rocket-like fashion through the opening where the primer was installed.

The enlarged chamber provides a greater volume in which the gas can expand, and equalizes the pressure inside and outside the projectile. This prevents side wall 164 from expanding and contacting the wall of the bore as the bullet travels down barrel. It also keeps the bullet centered in the bore and aligned with the axis of the barrel. Thus, the only point of contact between the bullet and the barrel is the ring 166 which forms the seal between the two. This ring is only about 0.075" to 0.080" wide, and the friction between it and the wall of the bore is minimal. It is deformed or shaved off as the bullet travels through the barrel.

The enlarged chamber also provides a greater combustion tolerance, and that permits the use of non-combustible additives in the gunpowder. Such additives can, for example, include detergents for cleaning the chamber and barrel each time the gun is fired, light chemical abrasives for preventing a build-up of gunpowder residue in the chamber and barrel, and fragrances for providing a more pleasant smell when the gun is fired.

The projectile itself serves as the primary chamber in which initial combustion of the gunpowder occurs, with the enlarged chamber in the breech block serving as a secondary chamber. With the opening at the rear of the cartridge being of limited size until the primer has fully separated, most of the gunpowder remains inside the projectile and burns there. Hence, the highest temperatures occur within the projectile, and the secondary chamber is mostly filled with a lower temperature, high pressure gas. Since the side wall of the projectile does not touch the chamber or the barrel, heat transfer is reduced, and friction is minimized. Moreover, a substantial portion of the heat of combustion is carried completely away from the gun by the projectile.

When the bullet is fired, the highest pressures occur in the chamber. As the bullet moves down the barrel, the volume behind it increases, and the pressure decreases, with the barrel acting mainly as a guide for the bullet. Consequently, the barrel does not have to be as strong as the breech block, and the sleeved barrel provides good heat dissipation through the aluminum receiver. This is important in preventing overheating or "cook off" in the chamber, particularly since caseless ammunition tends to produce more heat than conventional ammunition.

Because of the closed chamber and the absence of any means for ejecting a spent casing, the gun can only be used with caseless ammunition. To prevent someone from trying to use the wrong type of ammunition, the bore is made a non-standard size, e.g. .427 caliber.

Figure 7:
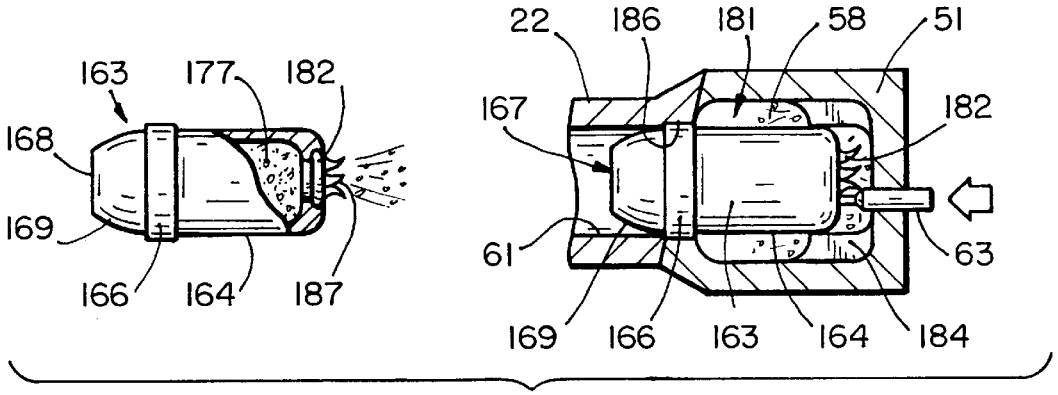
FIGS. 7 and 8 are cross-sectional illustrating other embodiments of caseless cartridges in chamber in the embodiment of FIG. 1 and in flight.

Another caseless cartridge 181 is illustrated in FIG. 7. This cartridge is similar to cartridge 162, and like reference numerals designate corresponding elements in the two cartridges. Cartridge 181 differs from cartridge 162 in that the rounded surface 169 at the rear of the nose increases only to the diameter of side wall 164, rather than to the diameter of ring 166. Also, the primer 182 in cartridge 181 is bursting primer which stays with the projectile, rather than popping off when the bullet is fired.

In the embodiment of FIG. 7, chamber 58 is of substantially greater diameter than the bullet, with radial guides 184 engaging the rear portion of side wall 164 to keep the cartridge centered. In this embodiment, ring 166 is received in short section 186 at the rear of the barrel which has a diameter corresponding to that of the ring.

The firing of this cartridge is similar to that of cartridge 162 except that the primer stays with the projectile, and the gases produced by combustion of the gunpowder pass though an opening 187 which is formed in the primer when it ruptures.

Figure 8:
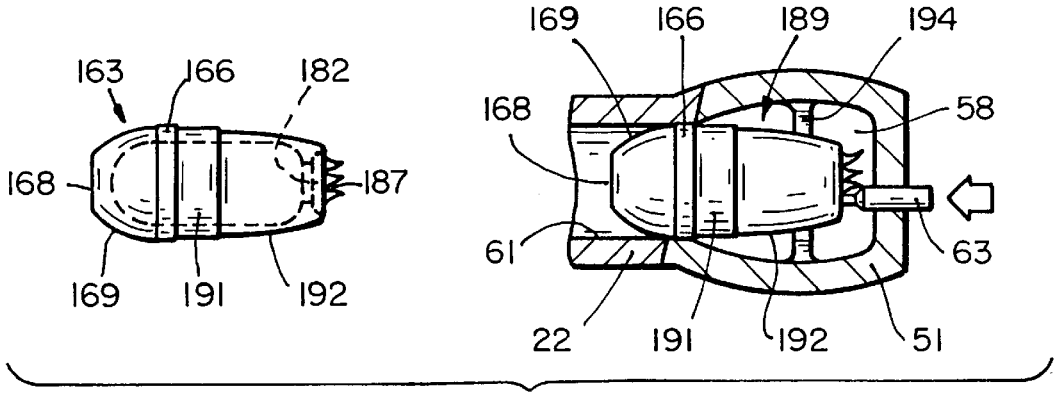

FIG. 8 illustrates a caseless cartridge 189 in which the projectile is tapered. This cartridge is generally similar to cartridges 162, 181, and like reference numerals designate corresponding elements in the three embodiments. Cartridge 189 has nose 167 which is similar to the nose of cartridge 162 except that the flat area 168 at the front of the nose is of somewhat smaller diameter. Ring 166 is somewhat narrower than the ring in cartridge 162, and a secondary bearing surface 191 is provided to the rear of the ring. The ring has a width on the order of 0.055" to 0.060", and bearing surface 191 has a diameter equal to that of the bore in the barrel. To the rear of the bearing surface, side wall 192 has a curved taper which decreases in diameter toward the rear of the cartridge.

In this embodiment, chamber 58 is also tapered, increasing in diameter from intermediate ring 186 to the rear of the chamber, opposite to the taper of the cartridge. Radial guides 194 engage the tapered side wall and hold the cartridge centered in the chamber.

The firing of cartridge 189 is similar to that of cartridge 181, with the secondary bearing surface 191 providing additional guidance as the bullet travels down the barrel of the gun. The aerodynamic shape of the tapered cartridge making it more stable in flight and more suitable for long range use than the other cartridges.

With all three of these cartridges, when the projectile strikes a target at an angle, the corner at the periphery of the flat central area hits the target first and tends to cut into the target rather than glancing off as a rounded or more pointed nose would do. In addition, a substantial vacuum forms behind the hollow, fast moving projectile as it travels through the air. When the projectile passes through a body, the vacuum draws tissue from the body behind it, giving the cartridge even greater destructive power.

The tubular magazine in the embodiment of FIG. 1 is advantageous in that it is compact and close to the barrel, and it gives the gun the appearance of a two-shot pocket gun,. rather than the semiautomatic pistol that it is. However, the number of cartridges it can hold is limited by the length of the barrel, and in a .427 caliber gun with a 3½ inch barrel, it can hold five rounds, which together with an additional round in the chamber, is still a considerable amount of fire power for a back-up gun. Also, since the magazine snaps into position, it can be changed quickly when more rounds are needed.

Figure 9:
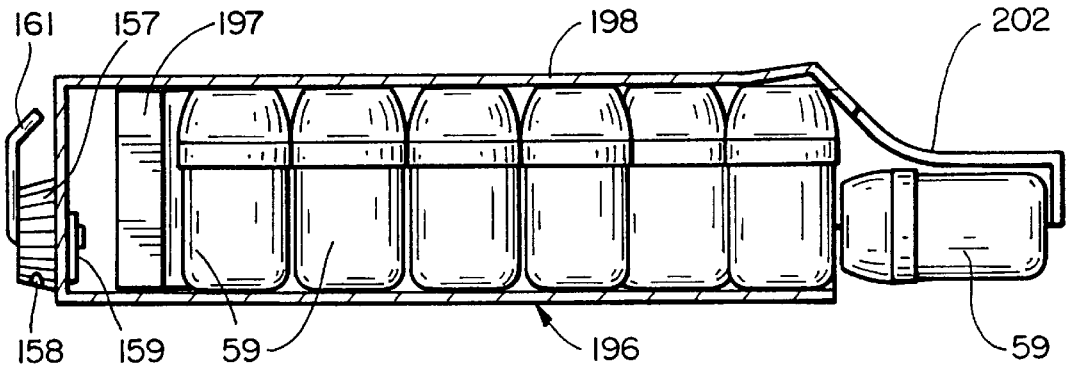
FIG. 9 is a vertical sectional view of another embodiment of a magazine clip for use in the embodiment of FIG. 1.
Figure 10:
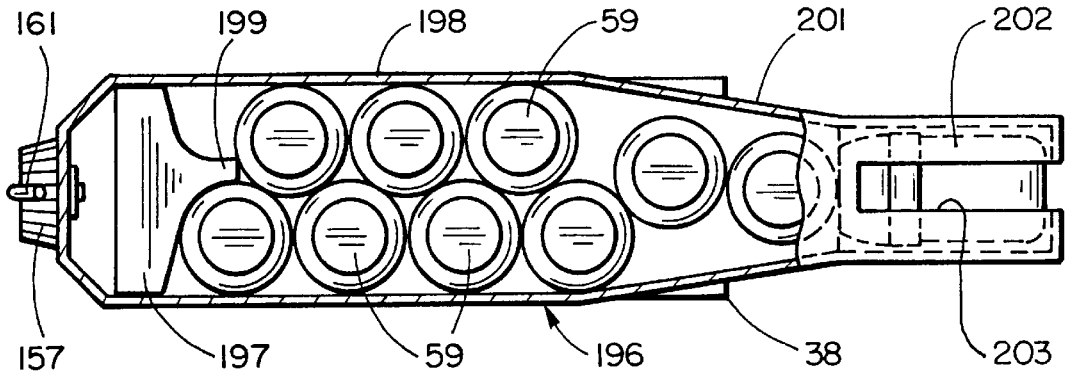
FIG. 10 is a horizontal sectional view of the embodiment of FIG. 9.

FIGS. 9 and 10 illustrate a magazine 196 in which the cartridges 59 are stored vertically in two staggered rows, with the noses of the cartridges facing up. This magazine is similar to magazine 128 in that the cartridges are pushed toward the rear by a piston 197 which is driven by gas pressure from the muzzle blast. However, in this embodiment, the magazine housing 198 and the piston have generally rectangular cross-sections, and the rear of the piston has a contour 199 corresponding to that of the cartridges.

Toward the rear of the magazine, housing 198 has a tapered section 201 in which the width of the housing decreases from the width of the two staggered rows of cartridges to the width of a single cartridge. In this section, the cartridges moving toward the rear of the magazine are fed alternately from the two rows to a single row.

To the rear of the tapered section, the housing has a downwardly sloping, upwardly concave top wall 202 which engages the nose of the cartridge at the rear of the tapered section and turns that cartridge to a horizontal position as it moves into the loading position at the rear of the magazine. A slot 203 in the top wall permits loader finger 151 to enter the magazine and press down upon the horizontal cartridge to load it into the firing chamber.

With .427 caliber ammunition and a 3½ inch barrel, magazine 196 can hold ten cartridges, as compared with five for the tubular magazine. This magazine is mounted to the receiver in the same manner as the tubular magazine and is readily replaced if additional rounds are needed.

Figure 11:
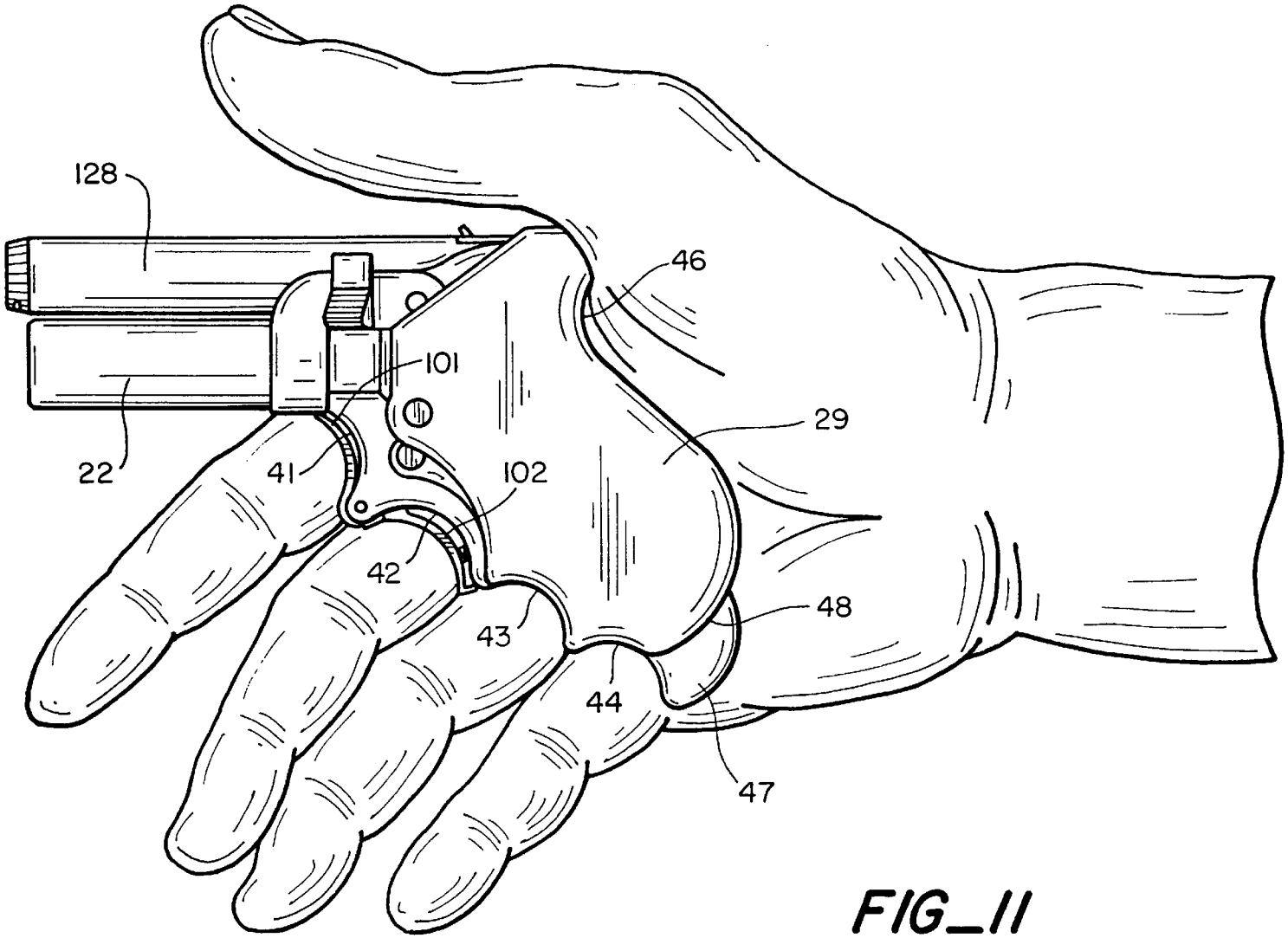
FIGS. 11 and 12 are actual-size side elevational views showing the embodiment of FIG. 1 in the hands of a shooter.

The gun is quite compact and is easily concealed or carried as a back-up weapon. FIG. 11 shows the gun in the hand of a shooter and illustrates just how small it is. The gun is shown approximately full-size, and the hand is that of an average size adult male. The grip is lying across the palm of the hand, with recessed areas 41–44 adjacent to the bases of the fingers. The heel of the hand is against the back of the grip, with the web of the hand in recessed area 46. With the gun in this position, the safety is on, with safety trigger 102 extended and primary trigger 101 retracted.

Figure 12:
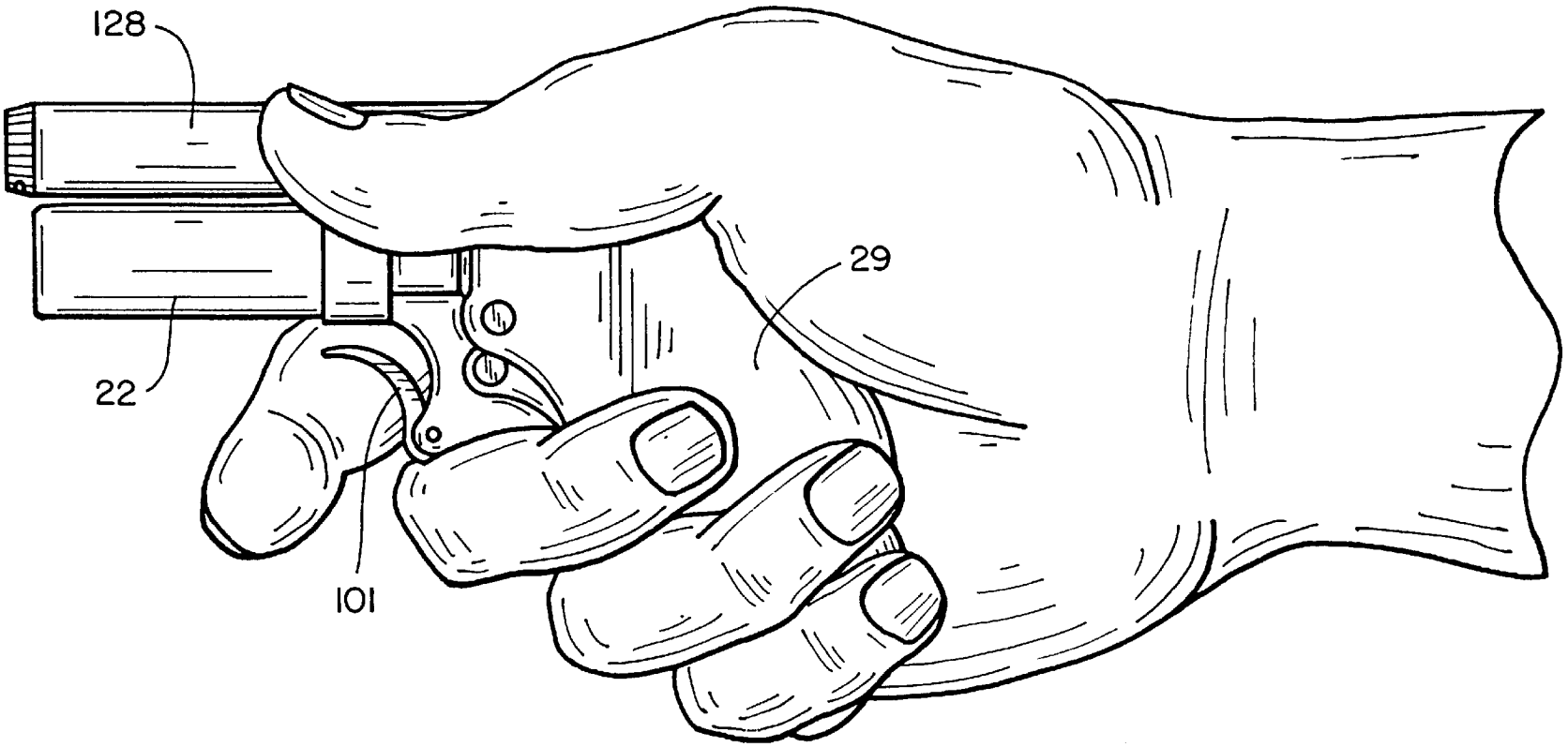

FIG. 12 shows the gun in the firing position, with the middle finger, ring finger and pinky wrapped securely about the grip, the thumb wrapped about the upper portion of the grip, and the forefinger in position to pull the trigger. The middle finger is holding safety trigger 102 in its retracted position, and trigger 101 is now extended and ready for firing.

Notwithstanding its small size, the gun can be held very securely, with a full three-finger grip and the thumb wrapped securely about the upper portion of the grip and the back of the grip resting against the meaty part of the hand between the thumb and forefinger. The axis of the barrel is parallel to the axis of the forearm and only slightly above it, so that recoil forces are applied directly up the arm, with substantially no muzzle rise when the gun is fired.

Figure 13A:
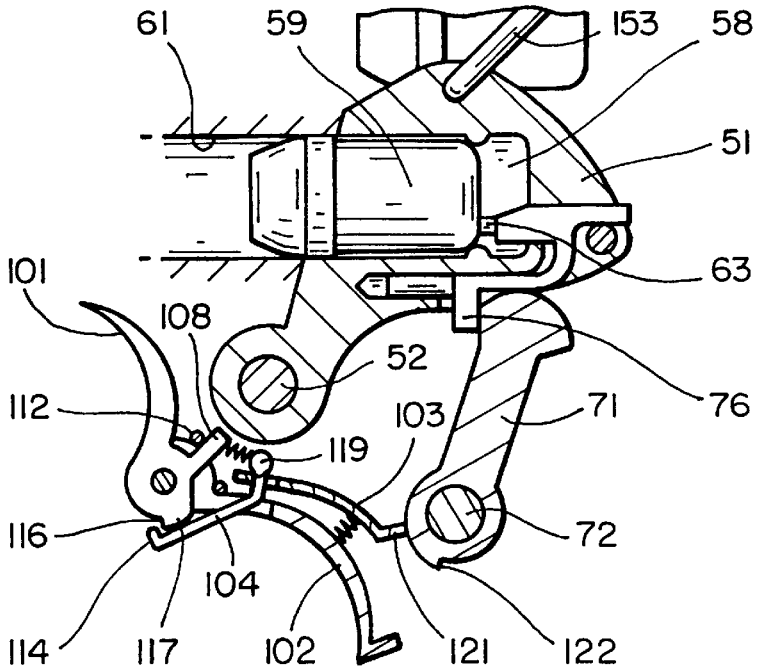
FIGS. 13A–13F are enlarged fragmentary views showing the action of the embodiment of FIG. 1 in different operating positions.

Operation and use of the gun are as follows. With the gun in its unarmed condition, as illustrated in FIG. 13A, the breech is closed, the hammer is in its rest position, the safety trigger is extended, and the primary trigger is retracted into the grip. If the chamber is empty, a cartridge can be loaded into it by unlocking the breech by moving the hammer away from its rest position with lever arm 93, then rotating the grip about halfway to its folded position to open the breech. As the breech opens, the breech block pulls down on the loader which delivers the rearmost cartridge from the magazine to the open breech. The breech block also moves the hammer to its cocked position where it is retained against the force of the hammer spring by sear 103. When the grip is returned to its normal position, the breech is closed by its spring, and the cartridge is pushed into the chamber.

Figure 13B:
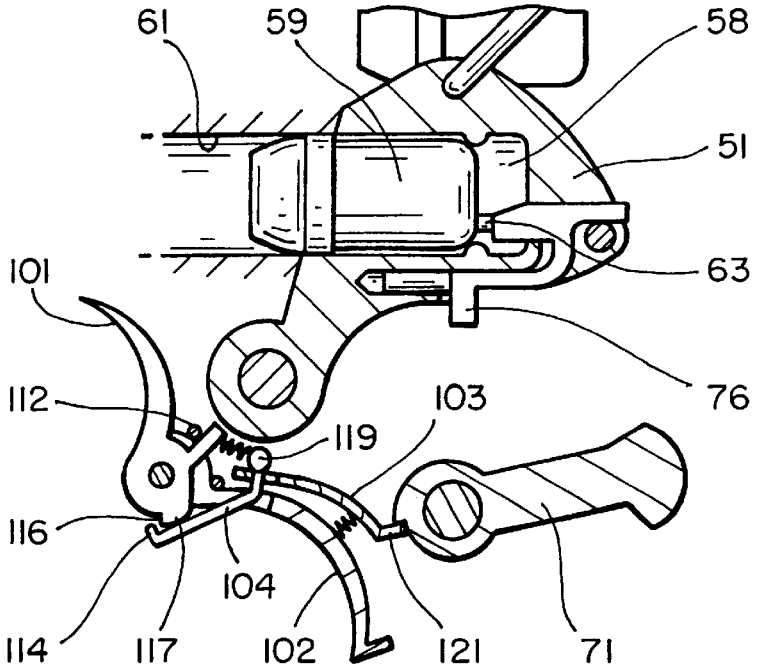
Figure 13C:
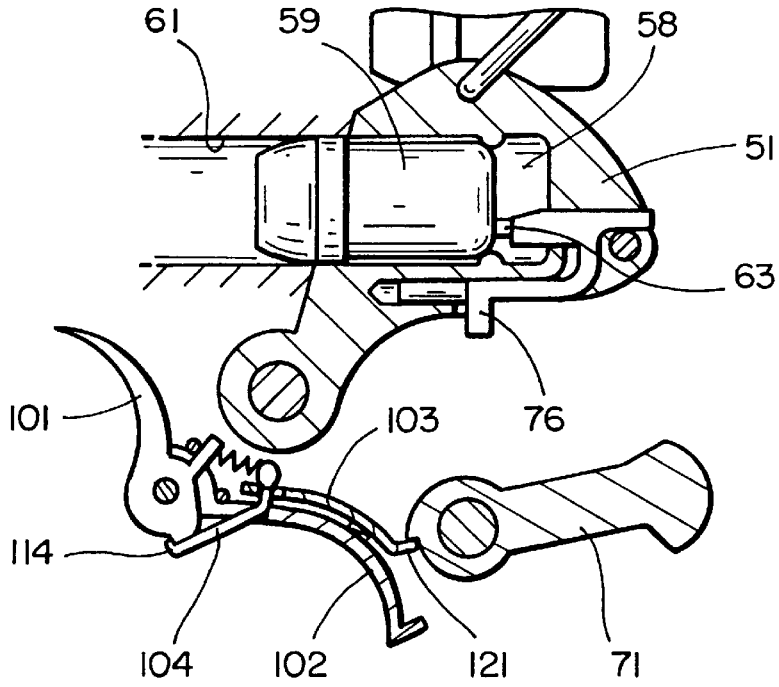
Figure 13D:
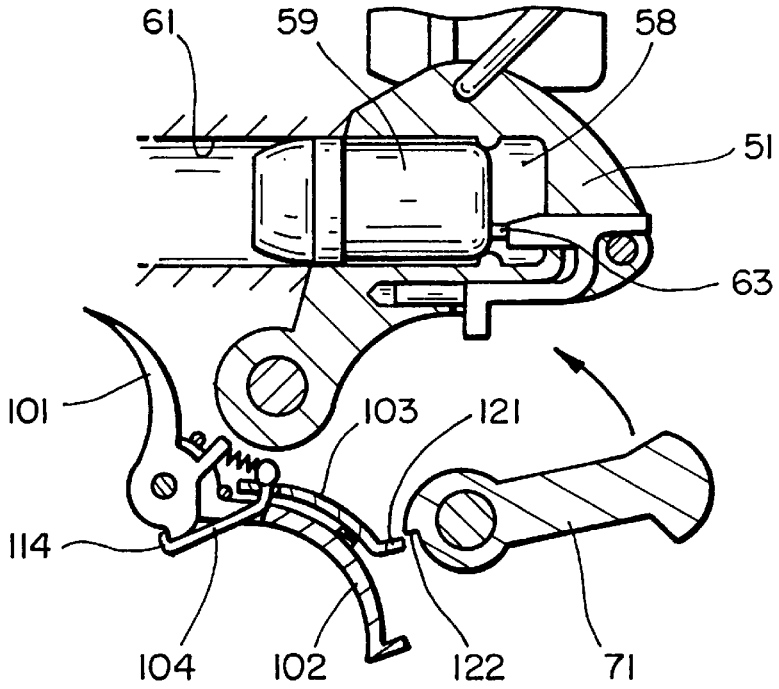

With the hammer cocked, as illustrated in FIG. 13B, safety trigger 102 is extended, trigger 101 is retracted into the grip, and sear hook 104 is disengaged from the trigger, so the gun cannot fire. To fire the round in the chamber, the shooter pulls back on the safety trigger, which extends the main trigger and engages the sear hook with the trigger, as illustrated in FIG. 13C. When the trigger is pulled, it will disengage the sear from the hammer, releasing the hammer to strike the firing pin which fires the cartridge in the chamber. FIG. 13D illustrates the action just after the hammer has been released and before it has started moving toward the firing pin.

Figure 13E:
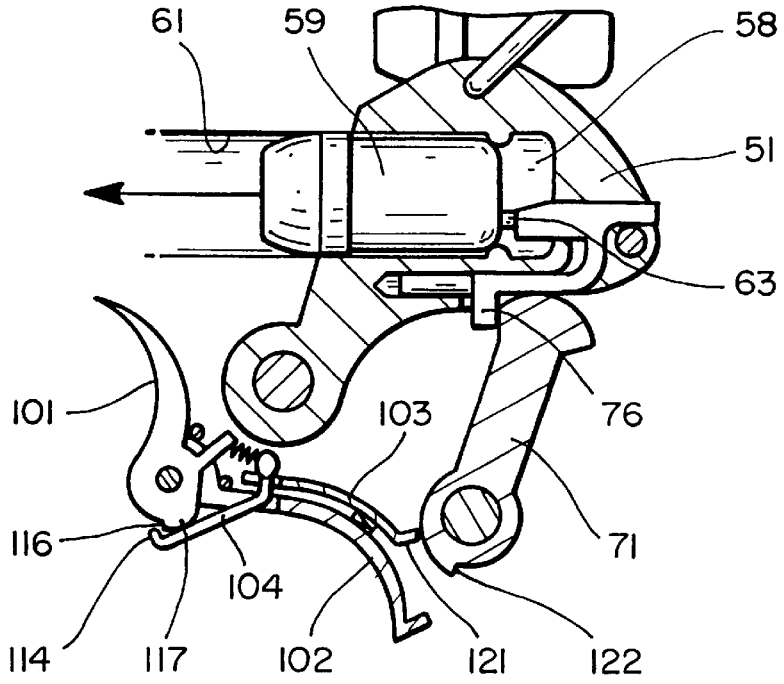

FIG. 13E shows the hammer striking the firing pin, with the cam surface 117 on the trigger disconnecting the sear hook from the trigger and the safety trigger 102 still in its retracted position.

Figure 13F:
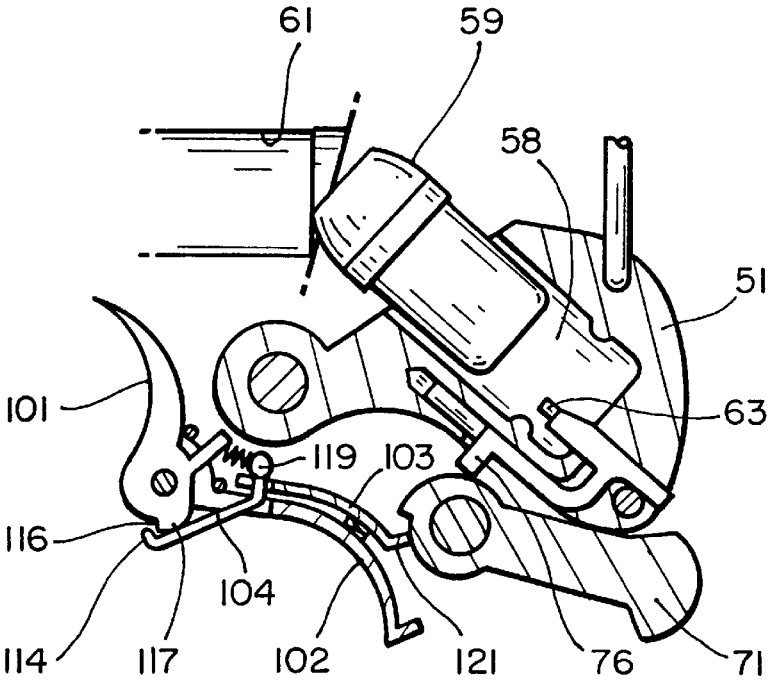

When the cartridge is fired, blowback in the chamber drives the firing pin back, with flange 76 engaging the hammer and moving it back far enough to unlock the breech block. The blowback then drives the breech block back to its loading position, cocking the hammer once again and loading the next round into the chamber, as illustrated in FIG. 13F. If the safety trigger is still depressed, that round can be fired simply by pulling the main trigger again. This process repeats as long as there are cartridges in the magazine.

When the magazine is empty, it can be removed and reloaded or replaced with another magazine. The magazine is loaded by opening reed valve 159 to vent the housing so that the piston can move back to the front of the housing, and loading the cartridges into the housing from the rear.

For additional compactness in storage and carrying, the grip can be folded up against the lower side of the barrel by disengaging latch 36 and rotating the grip to the folded position without engaging the hammer or the breech block with lever arm 93. In the event that there is a cartridge in the chamber and the hammer is cocked, the gun can be disarmed by using the grip and lug 98 to return the hammer to its uncocked or rest position. To do so, the grip is rotated toward the folded position until lug 98 is just in front of the cocked hammer. At that point, lever arm 93 is depressed to extend the lug, and the grip is rotated enough further to engage the hammer with the lug and lift it back from the cocked position. This releases the tension on the sear 103, which can then be disengaged from the hammer by manually pulling forward on sear hook 104 which is now exposed in front of the grip. With the sear disengaged, the grip is rotated slowly back to its rest position, with the lug extended, thereby returning the hammer to its uncocked position. The grip can then be rotated to its folded position, with the gun disarmed.

The invention has a number of important features and advantages. It provides a very compact gun which is light in weight and has semiautomatic action, excellent accuracy and enormous stopping power. It uses caseless ammunition which eliminates the need for spent case ejection, and it folds for even more compact storage and carrying. Because of its compact size and high stopping power, this gun is particularly suitable for use as a back-up weapon by law enforcement officers and the like.

The gun is inherently safe. The trigger is tucked away and decoupled from the hammer sear until the safety is released, and the gun is totally disabled when folded. The magazine is fully visible, with a cartridge in the loading position being visible both when the grip is in its normal position and when it is folded. The gun has a one-two trigger system in which the safety trigger must first be pulled to extend and engage the firing trigger, and then the firing trigger must be pulled to release the hammer.

The barrel is significantly longer than the barrels in other pocket guns, and the axis of the barrel is aligned closely with the axis of the forearm so there is almost no muzzle rise when the gun is fired. The gun has a full three-finger grip instead of the two-finger grip found in other pocket guns.

The gun has a substantially larger bore than other pocket guns and a much greater stopping power. With a 0.427" bore, the stopping power approaches that of a .44 magnum, compared to the .22 or .32 caliber bores of other pocket guns.

The action is totally contained within the grip, and there are no external moving parts other than the trigger and the safety trigger. The magazine is positioned above the barrel, which helps in keeping the barrel low and in line with the arm of the shooter. More efficient use is made of the space within the magazine by using a piston which is driven by gas pressure from the muzzle blast rather than a spring to move the cartridges toward the loading position.

The action is substantially less complex than in other guns, with the breech and the chamber being combined in a single element and the hammer serving as a breech lock. The hammer and the breech are powered by a unique spring which provides an unusually high range of spring action in a relatively small space.

With the caseless ammunition, most of the heat of combustion is carried out of the gun by the projectile. Since gas pressure inside and outside the projectile is equalized, the projectile does not expand, and it stays centered in the bore and aligned with the axis of the barrel as it travels down it. With very little contact between the projectile and the wall of the bore, heat transfer and friction are minimal, and with the sleeved barrel, the aluminum receiver easily dissipates what heat there is.

It is apparent from the foregoing that a new and improved pocket gun and cartridge have been provided. While only certain presently preferred embodiments have been described in detail, as will be apparent to those familiar with the art, certain changes and modifications can be made without departing from the scope of the invention as defined by the following claims.

What is claimed is:

1. A semiautomatic pistol which is small enough to be carried in a pocket or otherwise concealed on the body of a person, comprising: a contoured grip having areas for receiving all four fingers and the thumb of a shooter's hand, a barrel extending in a forward direction from the grip, a chamber positioned to the rear of the barrel, a magazine of cartridges positioned above the barrel, an action within the grip for firing a cartridge in the chamber, and means for feeding a cartridge from the magazine to the chamber in response to the firing of a cartridge by the action.

2. The semiautomatic pistol of claim 1 wherein the grip is rotatively mounted and can be moved to a folded position beneath the barrel for storage and carry.

3. The semiautomatic pistol of claim 1 wherein the grip has recesses in front for receiving the middle finger, the ring finger and the pinky of the shooter's hand, and a recess in back for receiving the web of the hand between the thumb and forefinger.

4. The semiautomatic pistol of claim 1 wherein the axis of the barrel intersects the grip below the top of the grip and at an angle such that the barrel will be aligned axially with the forearm of the shooter when the grip is held in the hand with the top of the shooter's wrist level with the top of the forearm.

5. The semiautomatic pistol of claim 1 wherein the barrel has a length on the order of 3½ inches.

6. The semiautomatic pistol of claim 1 wherein the barrel has a bore on the order of 0.427 inch.

7. The semiautomatic pistol of claim 1 including a trigger movable between extended and retracted positions for releasing the action to fire the cartridge when pulled, and a safety mechanism which disconnects the trigger from the action and holds the trigger in its retracted position until released.

8. The semiautomatic pistol of claim 7 wherein the safety mechanism includes a second trigger which when pulled moves the first named trigger to its extended position and connects the first named trigger to the action so that it can be pulled to release the action and fire the cartridge.

9. A semiautomatic pistol which is small enough to be carried in a pocket or otherwise concealed on the body of a person, comprising: a grip adapted to be held in the hand of a shooter, a barrel having a bore of predetermined diameter extending in a forward direction from the grip, a magazine of cartridges positioned above the barrel, a closed chamber at the rear of the barrel, a caseless cartridge in the chamber consisting of a hollow projectile filled with gunpowder with a primer for igniting the powder, means for firing the cartridge to expel both the projectile and the primer through the barrel, and means responsive to the firing of the cartridge for opening the chamber and transferring another cartridge from the magazine to the chamber.

10. The semiautomatic pistol of claim 9 wherein the primer is a pop-off primer which is mounted in an opening in the rear of the projectile for separation from the projectile when the cartridge is fired.

11. The semiautomatic pistol of claim 9 wherein the primer is a bursting primer which is mounted at the rear of the projectile and is adapted to rupture and provide an opening through which gas produced by ignition of the gunpowder can pass.

12. The semiautomatic pistol of claim 9 wherein the projectile in each of the cartridges has a side wall of lesser diameter than the bore, and a ring of slightly greater diameter than the bore for forming a seal with the wall of the bore as the projectile travels through the barrel.

13. The semiautomatic pistol of claim 12 wherein the projectile has a tapered side wall which decreases in diameter toward the rear of the projectile, and a secondary bearing surface which is equal in diameter to the bore and positioned between the tapered side wall and the ring.

14. The semiautomatic pistol of claim 12 wherein the chamber includes a portion of greater diameter than the side wall of the projectile for equalizing gas pressure inside and outside the projectile to prevent expansion of the side wall and contact between the side wall of the projectile and the wall of the bore.

15. The semiautomatic pistol of claim 12 wherein the cartridge and the bore are of a size such that conventional cartridges cannot be fired in the pistol.

16. A semiautomatic pistol which is small enough to be carried in a pocket or otherwise concealed on the body of a person, comprising: a grip adapted to be held in the hand of a shooter, a barrel extending in a forward direction from the grip, a breech block rotatively mounted in the grip for movement between firing and loading positions, a chamber formed in the breech block for holding a cartridge to be fired, a firing pin for firing the cartridge in the chamber, a hammer rotatively mounted in the grip beneath the breech block for driving the firing pin forward to fire the cartridge, and means responsive to firing of the cartridge for moving the breech block from its firing position to its loading position and loading another cartridge into the chamber.

17. The semiautomatic pistol of claim 16 wherein the hammer locks the breech block in its firing position after driving the firing pin forward.

18. The semiautomatic pistol of claim 16 wherein the grip can be rotated to a folded position beneath the barrel.

19. The semiautomatic pistol of claim 18 including selectively engagable means carried by the grip for engaging the breech block and the hammer to move the breech block to its loading position and the hammer to a cocked position upon rotation of the grip toward the folded position.

20. A semiautomatic pistol which is small enough to be carried in a pocket or otherwise concealed on the body of a person, comprising: a grip adapted to be held in the hand of a shooter, a barrel extending in a forward direction from the grip, a magazine of cartridges positioned above the barrel, a chamber positioned to the rear of the barrel, an action for firing a cartridge in the chamber, means for feeding a cartridge from the rear of the magazine to the chamber in response to the firing of a cartridge by the action, a gas driven piston within the magazine for pushing the cartridges toward the rear of the magazine, and means for admitting pressurized gas from the barrel into the magazine to drive the piston toward the rear.

21. The semiautomatic pistol of claim 20 wherein the means for admitting pressurized gas into the magazine includes a passageway having an inlet opening positioned near the muzzle of the barrel, and a one-way valve for allowing gas to pass through the passageway to the magazine.

22. The semiautomatic pistol of claim 20 wherein the magazine comprises a tubular housing, and the cartridges are aligned end-to-end within the housing.

23. The semiautomatic pistol of claim 20 wherein the cartridges stand vertically side-by-side in two staggered rows within the magazine, and the magazine includes means for feeding the cartridges into a single row toward the rear of the magazine and turning the rearmost cartridge to a horizontal position for feeding to the action.

24. A semiautomatic pistol which is small enough to be carried in a pocket or otherwise concealed on the body of a person, comprising: a grip adapted to be held in the hand of a shooter, a barrel extending in a forward direction from the grip, a breech block rotatively mounted in the grip for movement between firing and loading positions, a chamber formed in the breech block for holding a cartridge to be fired, a firing pin for firing the cartridge in the chamber, a rotatively mounted hammer for driving the firing pin forward to fire the cartridge, means responsive to firing of the cartridge for moving the breech block from its firing position to its loading position and loading another cartridge into the chamber, and a spring for urging the breech block toward its firing position and the hammer toward the firing pin, the spring comprising two sections each having first and second spiral windings positioned side-by-side, with a cross-over between the innermost convolutions of the two windings in each section, the outermost convolutions of the first windings in the two sections being connected together, and arms extending from the outermost convolutions of the second windings in respective ones of the two sections bearing against the breech block and the hammer.

* * * * *